United States Patent [19]

Owen

[11] 3,944,025

[45] Mar. 16, 1976

[54] FLANGED WHEEL LUBRICATING APPARATUS

[75] Inventor: Albert E. Owen, Portland, Oreg.

[73] Assignee: Electronic Flange Lubricators, Inc., Portland, Oreg.

[22] Filed: Sept. 9, 1974

[21] Appl. No.: 486,404

Related U.S. Application Data

[63] Continuation-in-part of Ser. No. 404,235, Oct. 9, 1973, abandoned.

[52] U.S. Cl. ..... 184/3 R; 222/390

[51] Int. Cl.[2] ..... B61K 3/00

[58] Field of Search ..... 222/390, 70, 337; 184/3 R

[56] References Cited

UNITED STATES PATENTS

| | | | |
|---|---|---|---|
| 1,685,040 | 9/1928 | Zbinden | 184/3 R |
| 1,934,407 | 11/1933 | Corey | 184/3 R |
| 2,160,784 | 5/1939 | Milbank | 184/3 R |
| 2,550,865 | 5/1951 | Ross et al. | 184/3 R |
| 2,719,602 | 10/1955 | Carter | 184/3 R |
| 3,011,590 | 12/1961 | Ouellette | 184/3 R |
| 3,165,171 | 1/1965 | Baeriswyl | 184/3 R |
| 3,783,971 | 1/1974 | Miyake | 184/3 R |

*Primary Examiner*—Charles J. Myhre
*Assistant Examiner*—William C. Anderson
*Attorney, Agent, or Firm*—Eugene D. Farley

[57] ABSTRACT

Lubricating apparatus for the flanged wheels of railroad rolling stock comprises a lubricant applicator coupled to a source of lubricant under pressure. The applicator comprises a head engaging the wheel flange and coupled to a pivotally supported hollow shaft. A solenoid-operated, screw-driven piston working in a cylinder filled with lubricant supplies lubricant in metered amount to the hollow arm and thence to the applicator head, which spreads it in a uniform film on the flange of the wheel.

15 Claims, 13 Drawing Figures

FLANGED WHEEL LUBRICATING APPARATUS

This application is a continuation-in-part of the patent application of Albert E. Owen, Ser. No. 404,235, filed Oct. 9, 1973, and now abandoned, for FLANGED WHEEL LUBRICATING APPARATUS.

BACKGROUND OF THE INVENTION

This invention relates to lubricating apparatus for the flanged wheels of railroad rolling stock.

It is well known that in the absence of lubrication the passage of heavy tonnage railroad rolling stock over the rails causes severe wear to both rails and wheels. Thus passage of a 100-car freight train over a single curve will peel as much as three pounds of steel off the rails. It also severely wears the wheel flanges and treads so that frequent changing or turning of the wheels is required.

U.S. Pat. No. 3,011,590 describes a flange lubricator which in large measure overcomes this problem by applying a suitable lubricant directly to the flanges of selected wheels of the rolling stock, particularly the locomotive. This maintains on the locomotive wheel flange a film of lubricant which is transferred to the rails and thence to the flanges of the wheels of the following cars. As time goes on, the tracks and rolling stock wheels of the entire system become coated with a thin but effective layer of lubricant which overcomes the wear problem and reduces maintenance to a minimum.

This particular lubricating system, while highly useful, relies for the lubricant drive upon mechanical linkages tied to relative movement occurring between the sprung and unsprung portions of the railroad car trucks. The amount of lubricant delivered to the wheel flanges thus is a function of the degree of roughness or smoothness of the road bed. Also, the nature of the mechanical linkages is such that it is possible for them to stop in a dead center condition when the train comes to a halt. Putting the train subsequently in motion then damages the linkages.

It accordingly is the general object of the present invention to provide lubricating apparatus for the flanged wheels of railroad rolling stock which apparatus applies lubricant uniformly to the wheel flange irrespective of the condition of the road bed and which is characterized by the following additional advantages:

It is not subject to breakage upon starting and stopping the train.

It is operative in both forward and backward directions of movement of the train.

It is applicable in structural situations where there is limited clearance between the locomotive cab and the wheel trucks.

It applies the lubricant selectively to the flange of the wheel, without transferring it to the wheel tread, where it would cause slippage and require excessive sanding.

The amount of lubricant which it delivers is adjustable easily.

The lubricant is applied by means of an applicator head which fits the flange accurately under all conditions of travel without creating a condition of wear either to the head or to the flange.

Use of the lubricator is safe in that even though it is in constant contact with the rapidly turning wheel, it does not generate sparks which would create a fire hazard.

The applicator head is properly located with reference to the wheel flange at all times irrespective of road bed conditions, atmospheric conditions, and length of use.

GENERAL STATEMENT OF THE INVENTION

Broadly considered, the hereindescribed flanged wheel lubricating apparatus which accomplishes the foregoing and other objects comprises a lubricant applicator unit adapted to discharge lubricant on the flange of the wheel, a lubricant drive unit providing a source of lubricant under pressure, and conduit means interconnecting the two units.

The lubricant applicator unit in a first embodiment comprises an applicator head adapted to lie adjacent the wheel tread and having a groove contoured to receive the wheel flange. The applicator head is supported on a trunnion-mounted hollow shaft, the bore of which communicates through the conduit means with the lubricant drive unit. Means are provided for positioning the arm both horizontally and vertically so that the applicator head at all times is in proper working relation to the flange of the wheel.

The lubricant applicator unit in a second embodiment is generally similar to that described above with the variation that the shaft comprises forward and rearward segments and pivotal connecting means connecting the segments for angular movement of the forward segment radially with respect to the wheel. The rearward shaft segment comprises a flat plate mounted in tracks for longitudinal movement of the shaft. This construction permits application of the apparatus in structural situations where there is limited clearance between, for example, the locomotive wheel trucks and the cab.

The lubricant drive comprises a cylinder adapted to contain lubricant and fitted with a screw-driven piston. Ratchet-driven gear wheel means is arranged in driving connection to the screw. An electrically operated drive, specifically a solenoid drive with associated crank and gear means, drives the screw at a predetermined continuous rate as long as the locomotive engine is under way. This causes the discharge of a small but effective amount of lubricant from the applicator head upon the flange of the wheel.

THE DRAWINGS

Considering the foregoing in greater detail and with particular reference to the drawings wherein.

DETAILED DESCRIPTION OF SPECIFIC EMBODIMENTS a. The Embodiment of FIGS. 1–8

Figure 1:
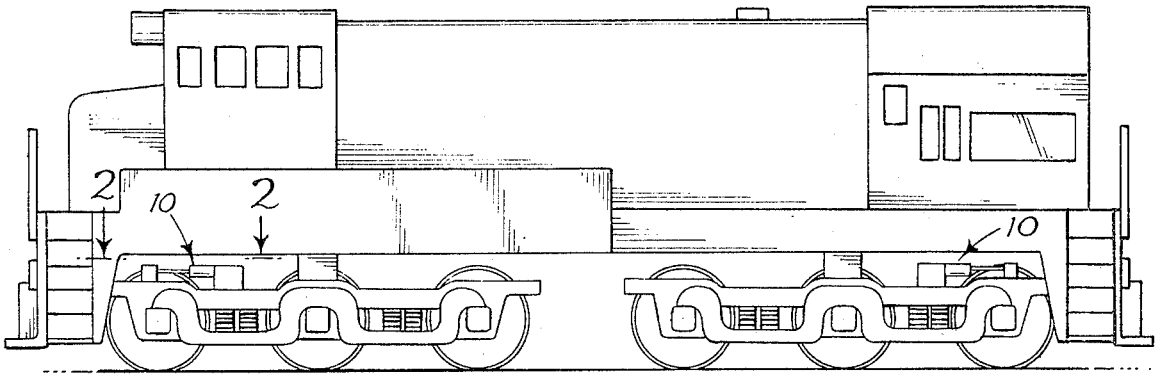
FIG. 1 is a schematic side elevation of a railroad diesel locomotive illustrating the manner of placement of the hereindescribed flanged wheel lubricating apparatus on the wheels thereof.
Figure 2:
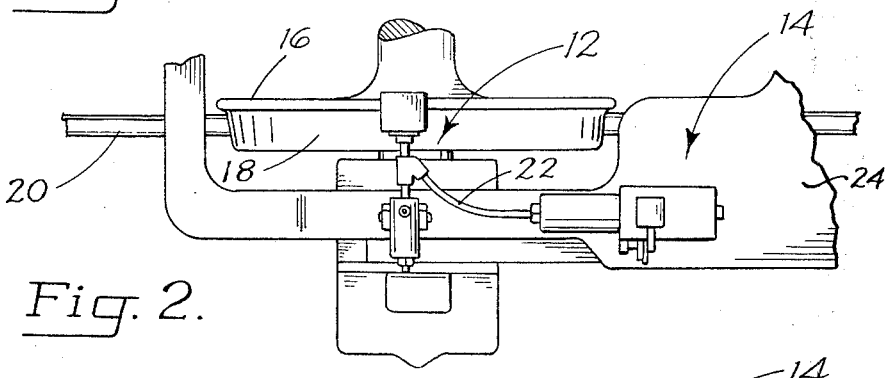
FIG. 2 is a detailed plan view of the apparatus looking in the direction of the arrows of line 2—2 of FIG. 1.
Figure 3:
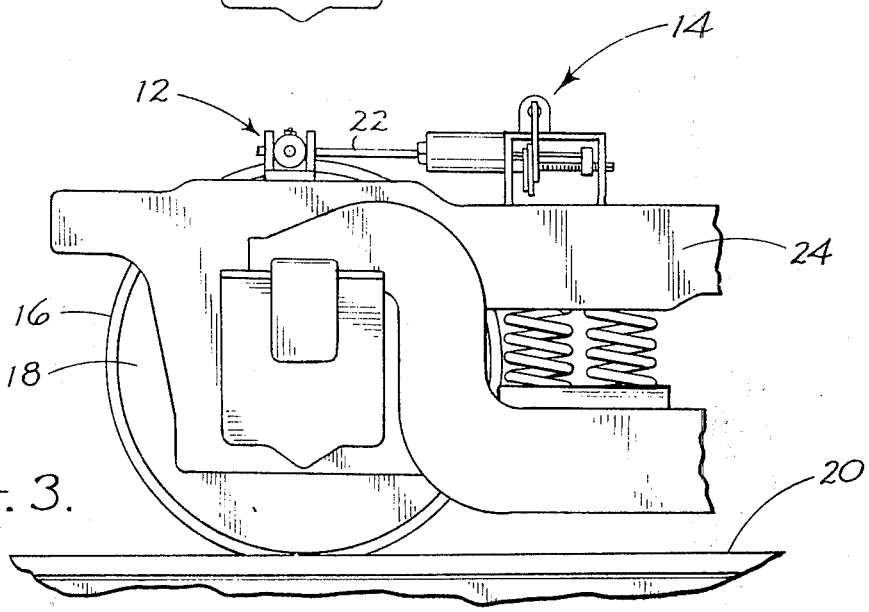
FIG. 3 is an enlarged view in elevation of the apparatus.
Figure 4:
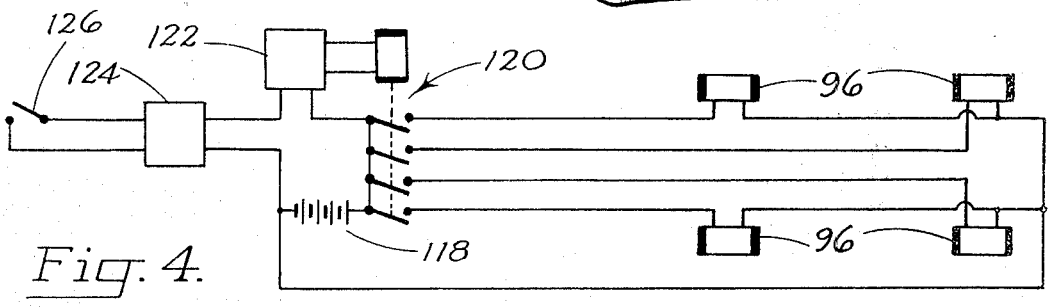
FIG. 4 is a schematic wiring diagram illustrating the electric circuit for the apparatus.

As illustrated in FIGS. 1, 2 and 3, the presently described flanged wheel lubricating apparatus, indicated generally at 10, consists of a lubricant applicator unit, indicated generally at 12, and a lubricant drive unit, indicated generally at 14. The assembly is designed to apply lubricant selectively to the flange 16 of a railroad car or locomotive wheel 18 tracking on rail 20.

The two units of the apparatus are connected through a flexible conduit 22 and are mounted on a suitable frame member, such as frame member 24 of the truck mounting wheel 18.

Figure 5:
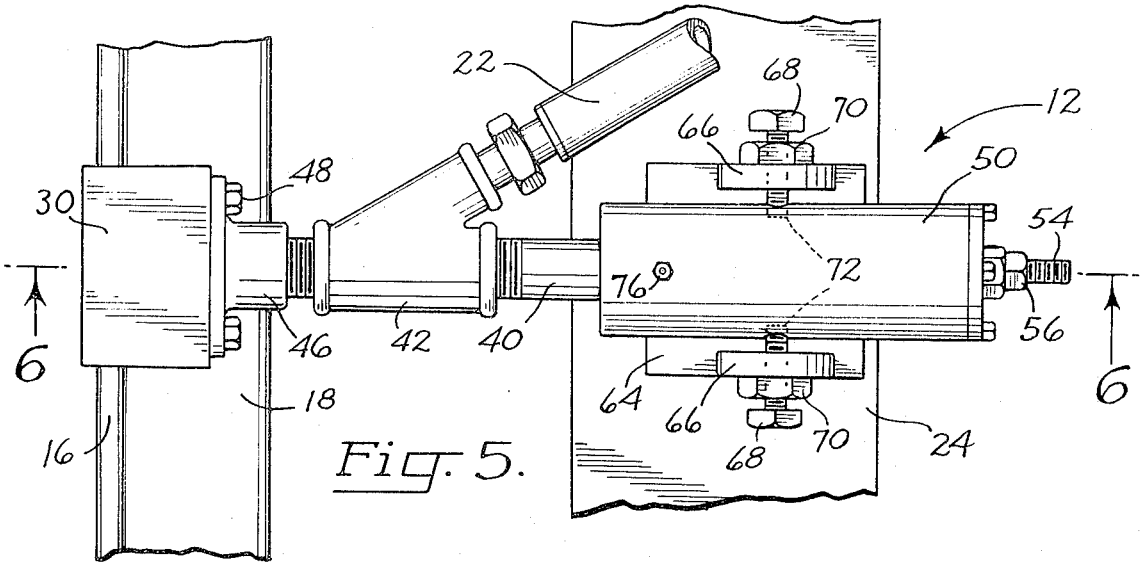
FIG. 5 is an enlarged plan view of the lubricant applicator unit of the apparatus.
Figure 6:
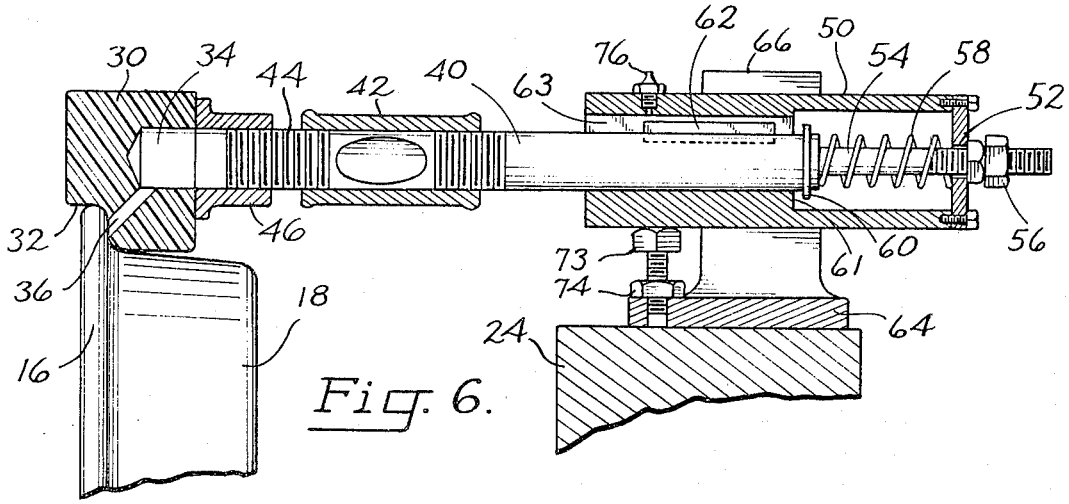
FIG. 6 is a longitudinal sectional view taken along line 6—6 of FIG. 5.

The particular construction of the lubricant applicator unit is illustrated in detail in FIGS. 5 and 6.

This unit of the assembly includes an applicator head 30 having a corner recess 32 dimensioned and contoured to receive flange 16 of the railroad car wheel, an inner chamber 34 communicating with the exterior on the rear face of the head, and a channel 36 communicating with chamber 34 and opening out into recess 32 immediately adjacent flange 16.

Head 30 preferably is made of a non-metallic material such as micarta. This is a synthetic product made up of layers of fabric impregnated with a hardened resin. It may be machined, is hard and durable, and is a non-conductor of electricity. In addition, upon frictional contact with the wheel flange it does not generate sparks and thus is free from a fire hazard.

Mounting means are provided for mounting head 30 in such a manner that in its working position it rests in counter balanced condition adjacent flange 16.

The mounting means employed for this purpose comprises an arm or shaft 40 having a threaded outer end which mounts a Y fitting 42, one leg of which is coupled to flexible conduit 22.

A nipple 44 has one of its ends threaded into the end of Y 42 and the other of its ends threaded into a gland 46. The latter is bolted by means of bolts 48 across the back face of applicator head 30 with the opening in the nipple, and hence of arm 40, registering with recess 34 of the applicator head and accordingly communicating therewith.

The rearward end of arm 40 is received in longitudinal sliding engagement in a sleeve or guide 50.

The forward end of guide 50 is open; the rearward end, closed by means of a cover plate 52 bolted across it.

An extension 54 of sharply reduced diameter extends rearwardly from arm 40 coaxially therewith. This extension serves as an adjustment shaft. Its outer end is threaded and mounts lock nuts 56.

The extension mounts a compression spring 58 which bears on one end against the back end of arm 40 and on the other end against cover plate 52. It biases the arm outwardly for proper positioning of head 30. A stop ring 60 on the end of the arm prevents its overextension by abutment against a shoulder 61.

A key 62 is fixed to arm 40 and enters an appropriate longitudinally disposed keyway 63 in the wall of housing 50, thereby maintaining the proper aligment of the arm.

Trunnion-mounting means support housing 50, and hence arm 40, for pivotal movement in a vertical plane.

As shown in FIGS. 5 and 6, the trunnion-mounting means comprises a plate 64 welded or otherwise affixed to frame member 24 and supporting a pair of parallel, upwardly extending arms 66. The arms are provided with aligned threaded openings which receive bolts 68.

The ends of the bolts are seated in aligned sockets 72 in the outer wall of guide 50, thus providing the desired trunnion mounting which enables the applicator head or shoe 30 to rest gravitationally in operative position with respect to flange 16 of the wheel.

Proper positioning of applicator head 30 in the horizontal plane is obtained by adjustment of lock nuts 56 on arm extension 54. Proper positioning in the vertical plane is obtained by means of a vertical adjustment bolt 73 threaded into plate 64 and fitted with a lock nut 74. Adequate lubrication of the assembly is obtained by means of a grease fitting 76.

Figure 7:
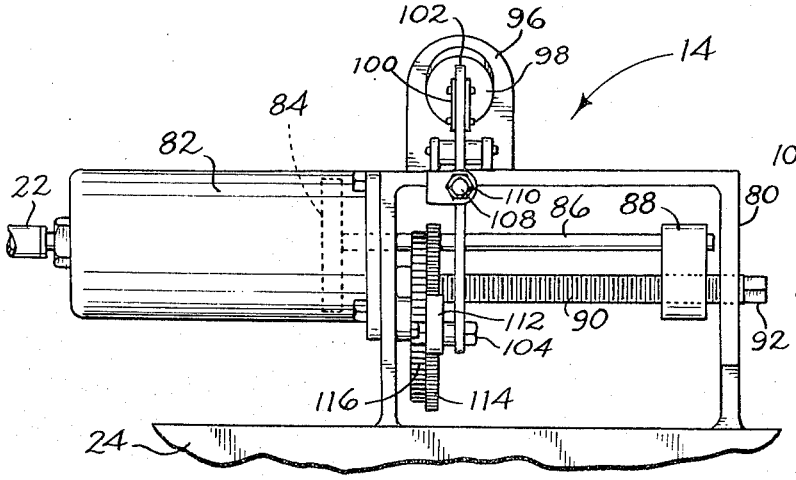
FIGS. 7 and 8 are views in side and end elevation respectively of the lubricant drive unit component of the apparatus.
Figure 8:
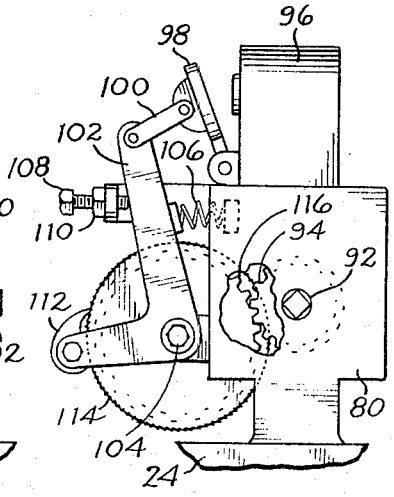

Applicator head 30 is supplied with lubricant, normally a solid grease, by means of a lubricant drive unit indicated generally at 14 and illustrated in detail in FIGS. 7 and 8.

Like unit 12, unit 14 is attached by welding or other suitable means to structural member 24. It is supported on a frame 80 in the shape of an inverted U.

Frame 80 mounts on its outer face a cylinder 82. This is adapted to contain a quantity of grease or other lubricant and is fitted with a piston 84.

Piston 84 is driven by means of a piston rod 86. The rearward end of the piston rod is fixed to a feed screw nut 88. The latter has a threaded bore engaging the threads of a drive screw 90 arranged parallel to piston rod 86 and having a squared rearward end 92 which extends beyond the plane of the rearward leg of frame 80. The forward end of feed screw 90 is integral with a spur gear 94.

Both gear and feed screw are driven by a drive train which is electrically actuated. It includes a solenoid 96 with associated pivoted clapper 98 mounted on top of U-shaped frame 80. The clapper of the solenoid is pivotally connected to a link 100 which in turn is connected to one arm of a bell crank lever 102. This lever is pivoted centrally on a pivot bolt 104. It is spring pressed by means of a spring 106. An adjustable stop bolt 108 with associated lock nut 110 opposes the action of the spring.

The other end of bell crank lever 102 pivotally mounts a pawl 112. This engages a gear 114 mounted on a common shaft with, and fixed to, a second gear 116 of appropriate ratio. The teeth of gear 116 mesh with the teeth of gear 94 carried by drive screw 90.

Accordingly, operation of solenoid 96 intermittently will work clapper 98 and hence advance piston 84 by increments determined by the stroke of clapper 98. Operation of solenoid 96 is determined by means of an electric circuit indicated schematically in FIG. 4. In a typical installation, this circuit may include four solenoids 96 each driving one of the hereindescribed lubricating units. As indicated in FIG. 1, the four units may be located in pairs, two on each side of the railroad locomotive, where they will supply grease to the wheels thereof and also to the track and the entire train which follows.

The electric circuit is powered by means of batteries 118. It includes a four contact switch 120 operated by means of a relay 122. This makes and breaks the circuit to all of solenoids 96 simultaneously.

Relay 122 is in series circuit relationship with a timer 124. The latter in turn is energized by means of a switch 126 which is in the circuit controlling the locomotive drive.

b. The embodiment of FIGS. 9–13.

The form of the invention illustrated in FIGS. 9–13 is applied in the same general manner as is the previously described embodiment of FIGS. 1–8.

Figure 9:
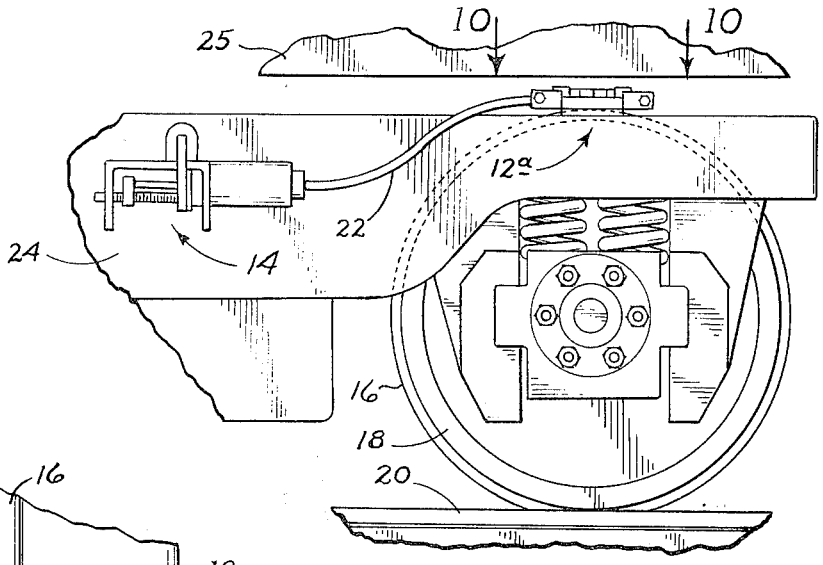
FIG. 9 is a view in side elevation similar to FIG. 3 but illustrating the apparatus in a second embodiment applied to structural situations of restricted clearance.
Figure 10:
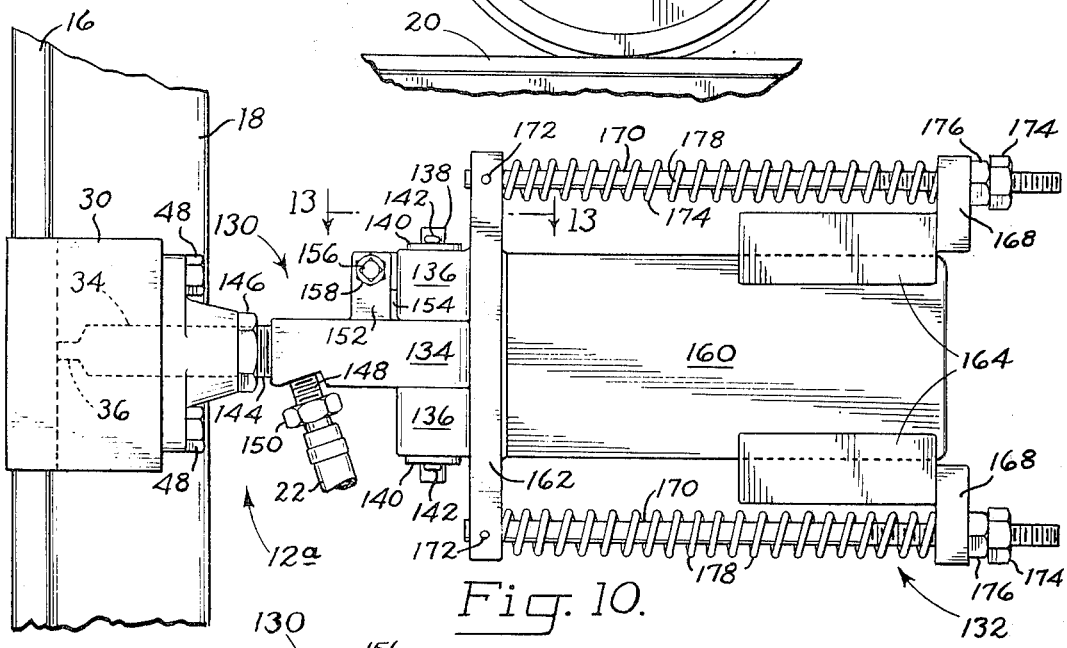
FIGS. 10 and 11 are views in plan and side elevation respectively, similar to FIGS. 5 and 6, and illustrating further the construction of the apparatus of the invention in its second embodiment.
Figure 11:
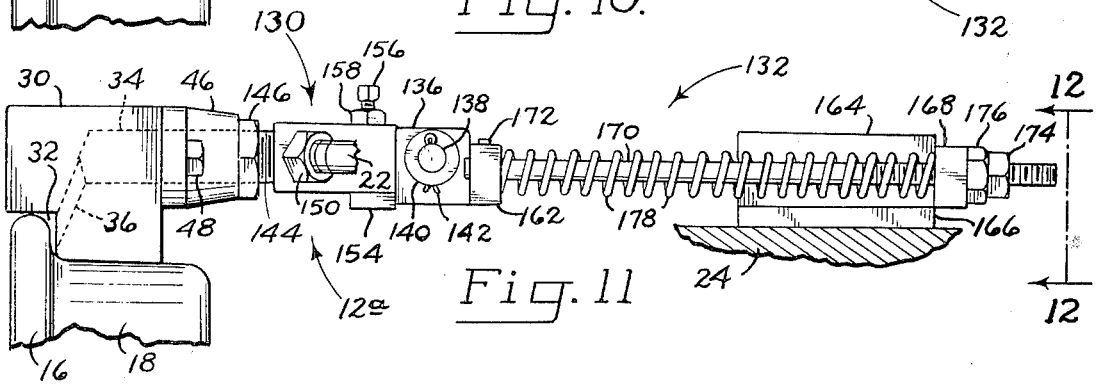
Figure 13:
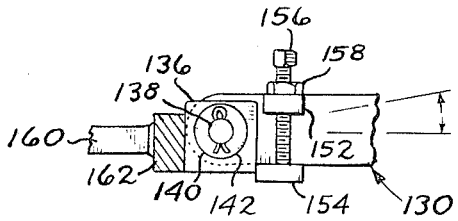
FIG. 13 is a detail sectional view taken along line 13—13 of FIG. 10.
Figure 12:
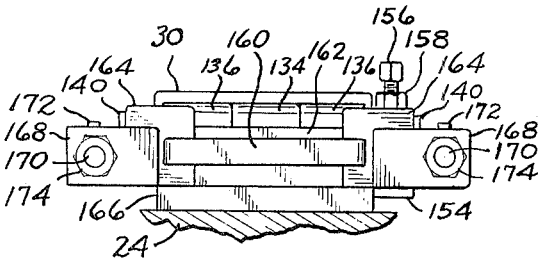
FIG. 12 is a view in end elevation of the apparatus of FIGS. 9–11, looking in the direction of the arrows of line 12—12 of FIG. 11.

Thus, as shown particularly in FIGS. 9 and 10, the apparatus consists of a lubricant applicator unit, indicated generally at 12*a*, and a lubricant drive unit indicated generally at 14. These components of the assembly are designed to apply lubricants selectively to the flange 16 of the railroad car or locomotive wheel 18 tracking on rail 20.

The lubricant applicator unit and lubricant drive unit are connected through flexible conduit 22 and are mounted on a suitable frame member such as frame member 24 of the truck mounting wheel 18. It is a particular feature of this embodiment that the lubricant applicator unit 12*a* may be mounted in structural situations where very limited space, e.g., a space of 2 inches or less, is present between the top of a locomotive truck 24 and its cab 25.

As before, the lubricant applicator sub-assembly includes an applicator head 30 which may be identical with that previously described. Thus it has a corner recess 32 dimensioned and contoured to receive flange 16 of the railroad car wheel, an inner chamber 34 communicating with the exterior on the rear face of the head, and a channel 36 communicating with chamber 34 and opening out into recess 32 immediately adjacent flange 16.

A gland 46 having an internally threaded opening communicating with recess 34 is secured to the outer face of head 30 by means of bolts 48.

In the presently described embodiment, head 30 is mounted on a shaft or arm which is pivoted intermediate its ends and accordingly comprises a forward segment indicated generally at 130 and a rearward segment indicated generally at 132.

The forward segment terminates in a rearwardly located knuckle 134 while the rearward segment terminates in a pair of laterally spaced, forwardly extending knuckles 136. The knuckles are interleaved and pivotally connected by means of a pin 138 with associated washers 140 and cotter keys 142. The net effect is to mount shaft segment 130 pivotally through a hinge type connection which permits the forward segment to move angularly radially with respect to wheel 18 as required to adjust its radial spacing from the wheel.

Means are provided for connecting forward segment 130 to head 30 and also the lubricant drive unit.

The means for connecting the forward segment to head 30 comprises a threaded, forwardly extending extension 144. This is bored longitudinally and is threaded into gland 46 where it is secured in a desired position of adjustment by means of lock nut 146.

The connecting means on shaft segment 130 for connection to the source of lubricant under pressure comprises a nipple 148 threaded into a drilled and tapped opening in the forward end of shaft segment 130 and communicating with the longitudinal bore therethrough. It thus forms a Y-connection similar to Y-connection 42 of the previously described embodiment.

Conduit 22 which communicates with the pressurized lubricant source is connected to the nipple and secured by means of nut 150.

Stop means are provided for arresting the angular movement of shaft segment 130 so that head 30, and in particular recess 32 thereof, is maintained a spaced distance from the flange 16 of the wheel so that lubricant supplied through conduit 22 is applied efficiently to the flange.

As illustrated, the stop means comprises a pair of vertically registering and vertically spaced tabs 152, 154. Tab 152 extends laterally from arm segment 130; tab 154, from knuckle 136.

An adjustment screw 156 is threaded through tab 152 and is supported thereby. Its lower end bears against and is stopped by tab 154. Adjustment screw 156 may be set at any desired position of angular adjustment of head 30, and maintained in this position by means of lock nut 158.

Rearward segment 132 of the applicator shaft essentially comprises a flat slide adapted to be inserted in the limited clearance area between locomotive truck 24 and cab 25, and secured to the former.

Thus it comprises a slide plate 160 having at its forward end a cross piece 162 on the forward face of which knuckles 136 are mounted.

Slide 160 is mounted in a pair of cooperating guides 164. These are integral with a base plate 166 which is welded or otherwise fixed to truck 24 of the locomotive.

As in the previously described embodiment, biasing means are provided for biasing the shaft assembly longitudinally in the direction toward and away from wheel flange 16, again to assist in placing lubricant delivery passageway 36 in proper operative relation to the flange.

The biasing sub-assembly is mounted on a pair of laterally extending brackets 168 welded to guides 164, and the ends of cross head 162 of slide plate 160.

Both of these elements of the assembly are provided with registering openings dimensioned to receive a pair of support rods 170. The forward ends of the rods are secured to cross head 162 by means of pins 172. The rearward ends of the rods extend through the openings in brackets 168 in freely sliding relation. They are threaded and mount lock nut pairs 174, 176.

Rods 170 mount biasing compression springs 178 the ends of which bear, respectively, against the extensions of cross head 162 and brackets 168.

In this manner, applicator head 30 is made doubly adjustable both angularly and longitudinally as required for precise operative placement with respect to the flange of the wheel to be lubricated.

OPERATION

In operation, whenever the engineer places the locomotive controls in drive position, either forward or reverse, switch 126 is closed. This energizes timer 124 which in a predetermined and adjustable time sequence, for example once every 15 to 45 seconds, operates relay 122 and closes the circuit to solenoids 96.

Each time a given solenoid is energized, it advances piston 84 of the associated grease-filled cylinder by a predetermined amount. This forces a predetermined amount of lubricant through flexible coupling 22 into Y 42 and thence into applicator head 30. There it is applied to flange 16 of the car wheel and produces the desired lubricating effect.

The application of lubricant to the wheels thus is independent of track conditions since the screw-driven piston derives energy from a timer-operated electric source. Still further, it is impossible for the apparatus to a stop in a dead center condition which, upon subsequent movement of the train, would destroy its components.

Upon achieving proper flange lubrication, every curve of the rails and every wheel flange on all the rolling stock will show traces of the flange lubricant after the passage of several trains. When this condition is reached, locomotive draw bar capability is increased from 10 to 30 percent. Flanges wear on all rolling equipment practically ceases. Flange life on locomotives increases over 500 percent. Tread wear also shows a marked decline. All of this is accomplished, furthermore, while keeping the grease on the flange without passing it to the tread where it would cause slippage of the wheels and require excessive sanding.

Having thus described my invention in preferred embodiments, I claim as new and desire to protect by Letters Patent:

1. In flanged wheel lubricating apparatus comprising a lubricant applicator unit adapted to discharge lubricant on the flange of the wheel, a lubricant drive unit providing a source of lubricant under pressure, and conduit means interconnecting the applicator and drive units, a lubricant drive unit comprising:

a. a cylinder adapted to contain lubricant and having a port communicating with the conduit means and fitted with screw-driven piston means behind the lubricant, b. ratchet-driven gear wheel means arranged in driving connection to the screw of rhe screw-driven piston means, and c. electrically operated drive means arranged in driving connection to the ratchet of the ratchet-driven gear wheel means, d. the drive means comprising an electric circuit, an electric solenoid in the circuit fitted with a clapper and including crank means interconnecting the clapper and the ratchet of the ratchet-driven gear wheel means, and electric timing means in the circuit for energizing the solenoid at predetermined intervals.

2. In flanged wheel lubricating apparatus comprising a lubricant applicator unit adapted to discharge lubricant on the flange of the wheel, a lubricant drive unit providing a source of lubricant under pressure, and conduit means interconnecting the applicator and drive units, a lubricant drive unit comprising:

a. a cylinder adapted to contain lubricant and having a port communicating with the conduit means and fitted with screw-driven piston means behind the lubricant, b. ratchet-driven gear wheel means arranged in driving connection to the screw of the screw-driven piston means, and c. electrically operated drive means arranged in driving connection to the ratchet of the ratchet-driven wheel means, d. the drive means comprising an electric circuit, an electric solenoid in the circuit, and electric timing means in the circuit for energizing the solenoid at predetermined intervals, the drive means being associated with the flanged wheel of a railway locomotive having a control for the locomotive drive, the electric circuit including a switch actuated by the locomotive control and operable to energize the timing means upon energization of the locomotive control.

3. In flanged wheel lubricating apparatus comprising a lubricant applicator unit adapted to discharge lubricant on the flange of the wheel, a lubricant drive unit providing a source of lubricant under pressure, and conduit means interconnecting the applicator unit and drive unit:

a. a lubricant applicator unit comprising 1. an applicator head adapted to lie adjacent a flanged wheel, having a groove contoured to receive a wheel flange, and a channel opening out on the flange, 2. a shaft mounting the head on its forward end and having a longitudinal passageway communicating with the channel on one end and the conduit means on the other, 3. guide means receiving the shaft and restricting the latter to longitudinal sliding movement relative thereto, 4. resilient shaft-biasing means interengaging the guide means and shaft for biasing the shaft outwardly in the longitudinal direction, and 5. stop means associated with the biasing means for limiting the longitudinal movement of the shaft under the applied bias of the biasing means; and b. a lubricant drive unit comprising 1. a cylinder adapted to contain lubricant and having a port communicating with the conduit means and fitted with screw-driven piston means behind the lubricant, 2. ratchet-driven gear wheel means arranged in driving connection to the screw of the screw-driven piston means, and 3. electrically operated drive means arranged in driving connection to the ratchet of the ratchet-driven gear wheel means, 4. the drive means comprising an electric circuit, an electric solenoid in the circuit, and electric timing means in the circuit for energizing the solenoid at predetermined intervals, the drive means being associated with the flanged wheel of a railway locomotive having a control for the locomotive drive, the electric circuit including a switch actuated by the locomotive control and operable to energize the timing means upon energization of the locomotive control.

4. In flanged wheel lubricating apparatus comprising a lubricant applicator unit adapted to discharge lubricant on the flange of the wheel, a lubricant drive unit providing a source of lubricant under pressure, and conduit means interconnecting the applicator unit and drive unit, a lubricant applicator unit comprising:

a. an applicator head adatped to lie adjacent a flanged wheel, and having a groove contoured to receive a wheel flange, and a channel opening out on the flange, b. a shaft mounting the head on its forward end, and having a longitudinal passageway communicating with the channel on one end and the conduit means on the other, c. guide means receiving the shaft and restricting the latter to longitudinal sliding movement relative thereto, d. resilient shaft-biasing means interengaging the guide means and shaft for biasing the shaft outwardly in the longitudinal direction, and e. stop means associated with the biasing means for limiting the longitudinal movement of the shaft under the applied bias of the biasing means.

5. The lubricant applicator unit of claim 4 wherein the head comprises a micarta head.

6. The lubricant applicator unit of claim 5 wherein the guide means comprises a guide sleeve, the biasing means is mounted in the guide sleeve behind the shaft, and trunnion means mounts the guide sleeve on a structural member for vertical pivotal movement.

7. The lubricant applicator unit of claim 6 wherein the guide sleeve means is closed at its rearward end with a back wall having a central opening therethrough and wherein the shaft has a rearward extension penetrating the opening, wherein the biasing means comprises compression spring means mounted on the extension inside the sleeve, and wherein the stop means comprises an abutment mounted on the shaft extension outside the housing and bearing against the back wall of the same.

8. The lubricant applicator unit of claim 7 wherein the shaft extension is threaded and wherein the abutment comprises lock nuts threaded onto the shaft extension outside the rear wall.

9. The lubricant applicator unit of claim 6 including a vertically arranged, adjustable, support post mounted on a support member beneath the guide sleeve means forwardly of the trunnion mounting means for supporting the applicator head in a predetermined position relative to the wheel flange.

10. The apparatus of claim 4 wherein the shaft comprises forward and rearward segments and pivotal connecting means pivotally connecting the segments for angular movement of the forward segment radially with respect to the wheel.

11. The apparatus of claim 10 including stop means for limiting the angular movement of the forward segment at a predetermined position of angular adjustment.

12. The apparatus of claim 10 including stop means for limiting the angular movement of the forward segment at a predetermined position of angular adjustment, the stop means comprising screw stop means threaded through one of the forward and rearward segments and bearing adjustably against the other.

13. The apparatus of claim 10 wherein the rearward segment comprises a flat slide plate and the guide means comprises a pair of laterally spaced tracks receiving the side margins of the plate in sliding engagement.

14. The apparatus of claim 13 including biasing means comprising compression spring means mounted between the slide plate and the tracks.

15. The apparatus of claim 13 including a cross head on the forward end of the slide plate, laterally extending brackets on the tracks aligned with the cross head, a pair of rods adjustably mounted between the cross head and brackets, one on each side of the slide plate, and compression spring means mounted on the rods and bearing against the cross head and brackets.

* * * * *